United States Patent [19]

Blachly

[11] Patent Number: 4,574,665

[45] Date of Patent: Mar. 11, 1986

[54] RATCHET WRENCH FOR ACCOMMODATING BOTH ENGLISH AND METRIC-SIZED WORKPIECES

[76] Inventor: Harry L. Blachly, 1705 Ravenwood, Arlington, Tex. 76013

[21] Appl. No.: 626,287

[22] Filed: Jun. 29, 1984

Related U.S. Application Data

[63] Continuation-in-part of Ser. No. 354,937, Mar. 5, 1982, abandoned.

[51] Int. Cl.[4] ..... B25B 13/46

[52] U.S. Cl. ..... 81/59.1; 81/58.2

[58] Field of Search ..... 81/54, 58.1, 58.2, 59.1, 81/179, 183, 186; 279/22, 24, 29–30, 62, 72, 76–77, 79–80

[56] References Cited

U.S. PATENT DOCUMENTS

| | | | |
|---|---|---|---|
| 2,550,010 | 4/1951 | Kavalar | 81/183 |
| 2,592,781 | 4/1952 | Yavner | 81/179 |
| 2,896,488 | 7/1959 | Ahana | 81/183 X |

FOREIGN PATENT DOCUMENTS

| | | | |
|---|---|---|---|
| 682326 | 8/1979 | U.S.S.R. | 279/22 |

*Primary Examiner*—Frederick R. Schmidt

*Assistant Examiner*—Debra S. Meislin

*Attorney, Agent, or Firm*—M. Lee Murrah

[57] ABSTRACT

A ratchet wrench comprising a generally cylindrical and flat head having an opening in its center for engaging workpieces. Interiorly of the head are two sets of cusps which are sized to receive certain cams; the inner cusps are adapted to transmit torque to a workpiece, and the outer cusps provide clearance when the wrench is being rotated in a non-driving direction. A pair of face plates are affixed respectively to opposite sides of the head so as to form front and rear face plates; the face plates are affixed to the head with mechanical fasteners that are spaced sufficiently close so that adjacent fasteners are no more than ¾ inch apart. A plurality of work-contacting cams are mounted between the face plates and arranged to be generally co-extensive and parallel. The cams collectively have a first set of ends adjacent the front face plate, and a second set of ends adjacent the rear face plate; and at least one of the two sets of cams ends are beveled so as to foster the entry of a workpiece into the central opening in the wrench head. The beveled ends of the cams preferably have a textured surface so as to foster frictional interaction with the workpiece at the time that engagement is being effected.

11 Claims, 7 Drawing Figures

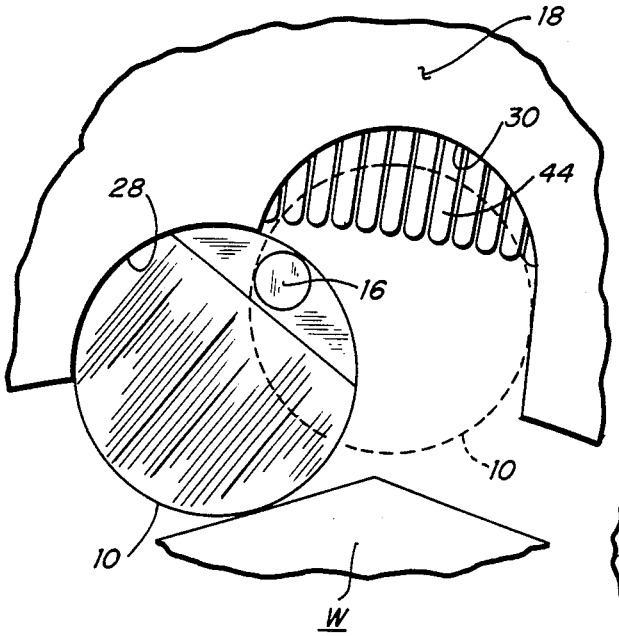
FIG. 4
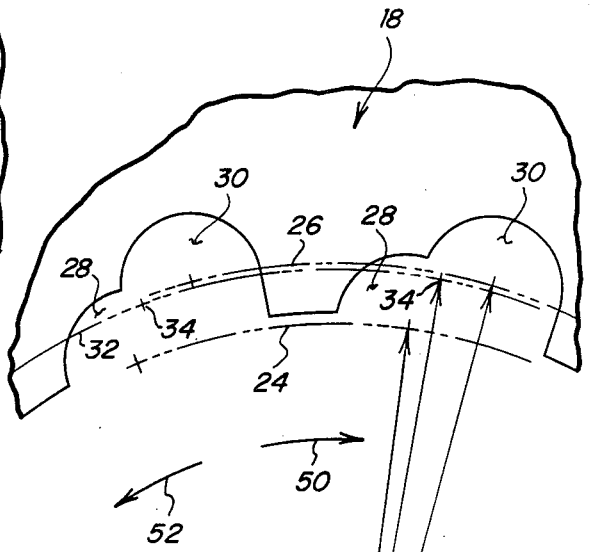
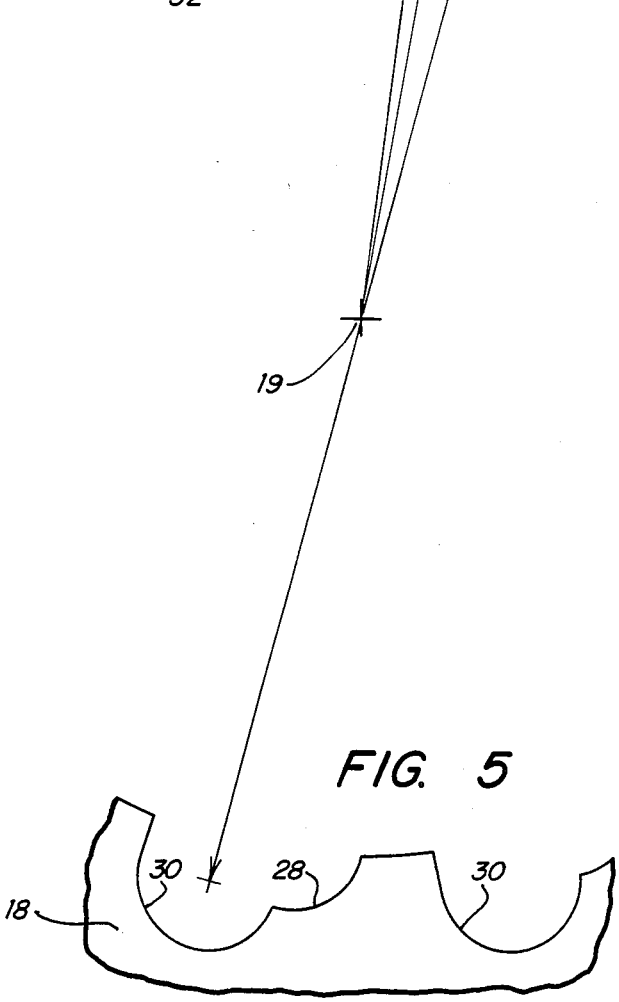
FIG. 5
| WRENCH | BRITISH SIZE inch | METRIC SIZE mm |
|---|---|---|
| A | 3/8 | 10 |
| B | 7/16 | 11 |
| D | 1/2 | 13 |
| F | 9/16 | 15 |
| G | 5/8 | 16 |
| I | 11/16 | 18 |
| J | 3/4 | 19 |
| K | 3/4 | 20 |
| L | 13/16 | 21 |
FIG. 7

RATCHET WRENCH FOR ACCOMMODATING BOTH ENGLISH AND METRIC-SIZED WORKPIECES

BACKGROUND OF THE INVENTION

This is a continuation-in-part of Ser. No. 354,937, filed Mar. 5, 1982, now abandoned.

The invention relates to wrenches, and more particularly to ratchet wrenches of the cam-lock type.

There are many occasions when it is desirable to apply torque to a workpiece in order to engage threads or twist the workpiece, etc. Examples of typical workpieces include nuts, pipes, bolts, hydraulic fittings, etc.; and, many proposals have been made from time to time with regard to applying torque to such elements. Perhaps one of the more successful devices in a ratchet wrench made in accordance with the teachings of U.S. Pat. No. 2,550,010 to Kavalar. Many wrenches of the Kavalar design have been manufactured by companies such as Utica Tool Company of Orangeburg, S.C., and they are commonly referred to as "cam-lock" wrenches. Because they have been utilized on elements which have been sized according to the British measuring system, such wrenches are identified as having openings, respectively for $\frac{3}{8}''$, 7/16", $\frac{1}{2}''$, 9/16" and $\frac{5}{8}''$ fittings, etc. That is, for openings on flare nuts that differ by only 1/16 of an inch, an individually sized wrench must be provided because the fit of a wrench around a nut must be so close that any given cam-lock wrench would be completely ineffective on a nut only 0.06 inch smaller. The necessity for such a close fit between the cams in a cam-lock wrench and the sides of an engaged nut has meant that conventional British-sized wrenches could not be used on most metric-sized nuts, even when the metric sizes were smaller than nominal British sizes. So, even though there is now developing at least some need for metric-sized wrenches, the demand has perhaps not reached the level which large manufacturers feel justified making such wrenches. Accordingly, there is developing a need for cam-lock wrenches which are usable on metric-sized structures, but thus far no U.S. manufacturer has been willing to expand its manufacturing lines in order to supply both British and metric sizes.

While it is true that other types of wrenches (such as open-end wrenches) are available in metric sizes, there are situations where the use of open-end wrenches is not tolerable because of time constraints. For example, in an automotive assembly plant wherein automobiles move along a conveyor line at a predetermined speed, the necessity to accomplish a particular job in a limited amount of time can preclude the use of tools that are perhaps functionally effective but are too slow. In these situations, the use of tools which foster speed in their operation is not only desirable, it is almost essential. The goal of "fast" tools is an improvement in the productivity of American workers, hopefully making U.S. made products more economically attractive throughout the world. But if a compaeny should be contemplating the conversion from English units to metric units, anything which would adversely affect productivity would naturally be categorized as a negative factor. There has remained a need, therefore, for an economical way of maintaining speed on an assembly line while also making possible a relatively "painless" switch from English to metric-sized fittings and hardware.

With regard to the assembly of automobiles in particular, the impact of federal regulations and standards must also be considered when any changes are contemplated in a component which might affect automobile safety. For example, the hydraulic fittings for power steering units must meet federal guidelines by having the flare nuts torqued to 30 foot-pounds. One expeditious way of achieving the required torque values is to employ pre-set torque wrenches which essentially guarantee that hydraulic fittings are properly tightened. It should be noted, though, that not just any torque wrench would be satisfactory for use on new cars. For example, a torque wrench having spherical elements such as those shown in U.S. Pat. No. 2,896,488 to Ahana would not be acceptable for hydraulic fittings, because the material from which hydraulic fittings are made is much softer than the material in standard nuts and bolts; and such soft fittings would be surely damaged by the concentrated, "point" pressure of spherical balls on the flats of such fittings. For this reason, locking elements having relatively long contact regions (such as the cylindrical rods shown in U.S. Pat. No. 3,386,319 to Bloom) are definitely preferred for such jobs.

Another problem arises in the real world when a large manufacturer elects to make the change from British-sized fittings to metric-sized fittings; the problem referred to here arises from the fact that a changeover is almost surely never instantaneous. In fact, it is almost guaranteed that there will be an overlap of some kind between the stocking of "old" British-sized units and "new" metric-sized units, unless a factory is swept clean and all British-sized units are pulled from inventory and discarded or sold as scrap. It could materially increase the amount of consumed time to assemble an automobile or the like if a worker was compelled to decide whether a given device had English or metric elements, and then he had to quickly select the correctly-sized wrench in order to match the elements he must tighten. If first one and then a differently sized unit was presented on an assembly line, the challenge to the worker might contribute to a headache. It would be highly desirable, therefore, to have a single wrench which would be capable of tightening *both* British-sized fittings and metric-sized fittings (which differ in size by small but not insignificant amounts). And, it is also important to anticipate problems which may arise when a repairman is compelled to work on an automobile or similar product after it has left an assembly plant. A mechanic's efficiency will naturally be improved if he can reach for a single wrench and know it will fit either a 9/16 inch nut or a 15 mm nut on a power steering unit, etc.

OBJECTS AND SUMMARY OF THE INVENTION

Accordingly, it is an object of this invention to provide a rachet-type wrench which is serviceable on either English-sized elements or similarly sized metric elements.

Another object is to provide for a relatively economical conversion from one size to a slighly different size in the manufacture of certain wrenches.

One more object is to foster the increased serviceability of a given size wrench so that it might be usable on nuts or the like which have a wider variation in external size than would otherwise be tolerable.

Still another object is to provide a technique for modifying existing cam-lock wrenches in order that their utility will be expanded.

These and other objects of the invention are accomplished in a cam-lock wrench by providing a planar bevel on the end of the cylindrical cams in such a wrench. This permits the corners of oversized nuts to engage the planar bevel when the wrench is turned in the reverse direction and cause retraction of the cams. This permits the oversized nut top slip into the opening between the cams.

BRIEF DESCRIPTION OF THE DRAWINGS

The invention may be more fully understood by reading the following description of a preferred embodiment in conjunction with the appended drawings, wherein:

FIG. 4 is a fragmentary top plan view of a portion of the wrench head, on an enlarged scale, and showing both the "drive" position of a cam (in solid lines) and the "clearance" position of a cam (in broken lines);

FIG. 5 is a fragmentary, top plan view, shown somewhat schematically, with regard to the geometry of an exemplary wrench head;

FIG. 7 is a table showing the nominal sizes of certain workpieces which can be accommodated by a single cam-lock wrench in accordance with this invention.

DETAILED DESCRIPTION OF A PREFERRED EMBODIMENT

Figure 1:
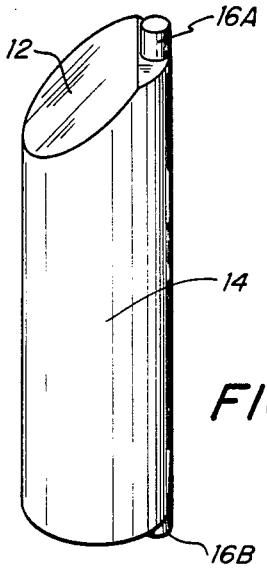
FIG. 1 is a perspective view of one of the work-contacting cams which has been configured to foster engagement with a workpiece, in order that the workpiece might be rotated in one direction.

Referring specifically to FIG. 1, a work-contacting cylindrical cam 10 is shown with a generally vertical orientation, such that its two ends may be referred to, for convenience, as top and bottom ends. The top end 12 is beveled in a direction that will become the "inner" side of the cam 10 when it is assembled in the wrench. The cylindrical side walls 14 still make up the bulk of the work-contacting surface, through which torque is applied to a workpiece when the wrench is turned in the correct direction. Also shown in this figure are two small pins 16A, 16B which extend respectively from the two ends of the cam 10 in a generally longitudinal direction. It is these two pins 16A, 16B which cooperate with the two holding plates to permit controlled rotation of a cam while restraining it within the wrench head. One way in which the pins 16A, 16B can be effectively retained is disclosed in the aforementioned Kavalar patent, wherein the pins loosely engage recesses or dimples in the juxtaposed face plates that are attached to the wrench head.

Figure 2:
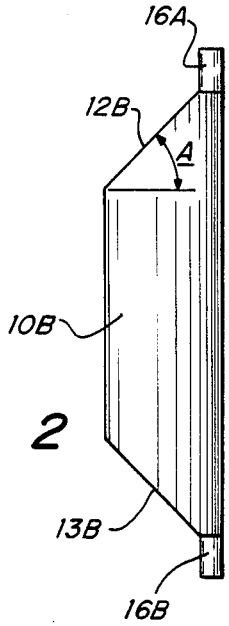
FIG. 2 is a side elevational view of another embodiment of the invention in which both ends of the cam have been beveled, such that a one-way wrench may be mounted on a workpiece from either side—so that the workpiece may be turned clockwise or counterclockwise (depending upon the direction in which the wrench was installed)

Referring next to FIG. 2, another embodiment of a work-contacting cam 10B is illustrated, with this particular cam having a beveled top end 12B and beveled bottom end 13B. The preferred angle for both beveled surfaces is at least 45 degrees with respect to a transverse plane through the cam, as indicated by the angle A in FIG. 2. Also, it has been found to be critical to make the beveled surface planar (flat), both for manufacturing economies and for smooth operation. Of course, the beveled surfaces on a cam must terminate at a location which ensures that the pins 16A, 16B are not undermined or otherwise weakened, because it is these pins which ensure that the cams are held within the generally cylindrical head of a wrench. The beveled portion at any end of a given cam ideally should constitute less that 25% of the cam's length, so that are least 50% of the original bearing area along the side of a cylindrical cam will remain unaffected by any beveling alternation. That is, if both ends of a cam are beveled (in order to foster engagement of a workpiece so that the workpiece can be turned either clockwise or counterclockwise), ensuring that are least 50% of the cylindrical surface remains to engage the workpiece will avoid the concentrated pressures which would otherwise be present if, say, a spherical member was utilized instead of a cylinder.

Figure 3:
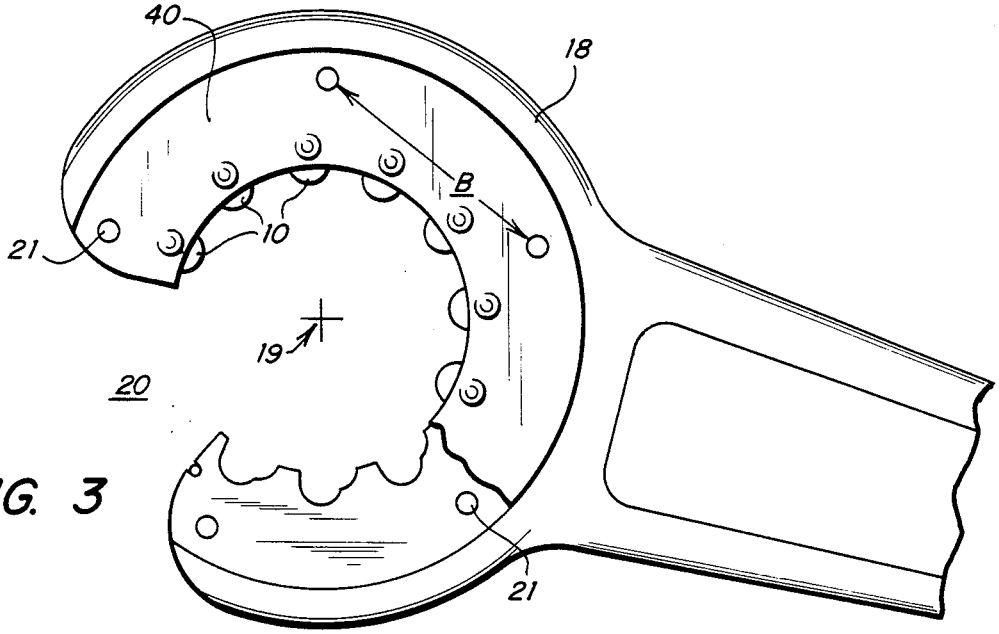
FIG. 3 is a top plan view of an exemplary wrench, with some of the cams being shown in their "rest" position (prior to engagement with any workpiece), and other cams being omitted in order to better show the head of the wrench.

Referring next to FIG. 3, the wrench of the invention includes a generally cylindrical and flat head 18 having an opening 20 along one side which is adapted to receive part of a workpiece, such as a tube having a flared fitting. When such a tube (not shown) passes through the opening 20, the wrench may be moved longitudinally and turned slightly until it is positioned around the fitting, as will be more thoroughly explained hereinafter. As seen in this view, the interior face, or periphery, of the head 18 may be described as having a generally C-shpaed configuration, with the "C" having a center 19 which coincides with the central axis of the head. Attached to the head 18 by a plurality of rivets 21 are two face plates, only one of which (plate 40) is visible in this figure. The rivets 21 are separated by a distance B, which experimentation has revealed should be no more than $\frac{3}{4}$ inch—which is much less than the spacing on similar, commercially available wrenches.

Another difference between the wrenches made in accordance with this invention and commercially available wrenches is the thickness of the face plates 40, 42. Through extensive testing it has been found that commercially available wrenches have face plates that are often too weak to reliably hold the cams in place in a wrench—even when the steel face plates are hardened to about $R_c45$. Accordingly, in order to foster endurance of a wrench for use on assembly lines and the like, the preferred thicknesses for the face plates are given in the following table:

| Nominal Size of Wrench | Face Plate Thickness |
|---|---|
| $\frac{3}{8}$ inch | 0.032 inch |
| $\frac{1}{2}$ inch | 0.035 inch |
| 9/16 inch | 0.036 inch |
| $\frac{5}{8}$ inch | 0.041 inch |
| 11/16 inch | 0.042 inch |
| $\frac{3}{4}$ inch | 0.044 inch |
| $\frac{7}{8}$ inch | 0.052 inch |

By providing an adequate thickness in the face plates 40, 42 and keeping the distances between adjacent mounting rivets 21 relatively short, the plates have sufficient rigidity to resist distortion under load; and the cams are found to remain in their intended positions for much longer periods of use. The retention of the cams within a wrench head is believed to be the key to a wrench's long life, because experience has shown that more wrenches are removed from service as a result of a *lost* cam than are discarded because of a *broken* cam.

The face plates 40, 42 have central openings that essentially match the size of the central opening in the wrench head, so that there will be no interference when a wrench and a workpiece are manually brought into engagement. As suggested earlier, it is possible to modify the cams in a "prior art" wrench that was originally manufactured to accomodate only a single size workpiece (e.g., ⅜ inch nuts) in such a way that the modified wrench can opeate on two closely sized workpieces (i.e., ⅜ inch and 10 mm nuts); but when this is done, it may also be necessary to make the central opening of the face plates slightly larger. This can be readily accomplished by grinding off a small amount of excess material along the interior edge of the C-shaped face plates, being careful not to cut into the region that contains the dimples or bearings that hold the cams within a wrench.

Referring next to FIG. 4, a greatly exaggerated representation of a cam 10 is shown in plan view, adjacent cusp-shaped indentations 28, 30 on ther interior side of head 18. The solid showing of the cam 10 represents the position that a cam would occupy when it is in contact with cusp 28; this constitutes the "driving" position of a cam, wherein it is wedged between the head 18 and a workpiece to which torque is to be applied. The broken line showing of the cam 10 represents the position that the cam would typically assume if the head was being turned in a counterclockwise direction around a fixed workpiece. Thus, when the wrench head is appropriately turned, the cam 10 can pivot about its longitudinal pins 16 into the clearance space in front of cusp 30. The cam 10 is always being urged inwardly by spring 44 toward the geometric center of the head; and, depending upon the instantaneous relative position between the head 18 and the workpiece, the cam will eventually be in a position to become wedged against cusp 28 when the wrench head is turned in a clockwise direction (as illustrated in this particular figure).

Turning next to FIG. 5, some of the plurality of cusp-shaped indentations 28, 30 are shown, with half of the indentations being closer to the center 19 of the head than the other indentations; also shown are two circles 24, 26 which are concentric with the head 18. The diameter of the smaller circle 24 is established by the locus of all centers of the cusp-shaped indentations 28. The plurality of cusp-shaped recesses 30 have their centers on the larger circle 26; and the inner and outer recesses are positioned so that they alternate with one another, as seen in a plan view. The two sets of recesses 28, 30 have essentially the same radii, although the deeper recesses 30 have a more full and recognizable shape because so much of each shallow recess 28 has been removed to provide clearance for cam movement and workpiece entry. The radii for recesses 28, 30 will vary, of course, depending on the size of the wrench and the corresponding size of the cams. That is, for turning small workpieces, the diameter of the cams 10 will typically be relatively small, e.g., about 3/32 inch; and the diameters of cusps 28, 30 to match such cams would be only slightly larger—just to ensure that the coincidence of a slightly oversized cam and a slightly undersized cusp would never tend to establish a wedged condition. A wrench for turning 18 mm workpieces would typically have ⅛ inch cams, and a 23 mm wrench would typically have 11/64 inch cams.

Also shown in FIG. 5 are a plurality of centers 34 which lie on an intermediate circle 32, i.e., a circle whose diameter is larger than the small circle 24 but smaller than the large circle 26. These centers 34 are positioned between the cusps 28, 30 so that a cam 10 whose pins 16A, 16B are mounted at the centers 34 can be rotated in such a way that the cam can "nest" within either inner cusp 28 or outer cusp 340. That is, each center 34 is located to establish a pivot axis that permits a cam to be rotated to either of its two extreme positions or to an intermediate position between its two cusp positions. Of course, the centers 34 have a geometric pattern that matches the location and spacing of the dimples (or other devices) on plates 40, 42 which are provided to hold the cams 10 in the wrench head.

When the wrench head 18 is turned with respect to a hexagonal workpiece in the forward direction as indicated by arrow 50, at least one—and usually more—of the cams will bear against a corner of the workpiece and will be rotated toward an inner cusp 28. Of course, continued rotation of the head 18 will eventually cause the cam to be wedged between its associated cusp 28 and the workpiece. Turning the head 18 in the reverse direction, as shown by arrow 52 is routinely employed to facilitate entry of a workpiece into what may very well be a "tight" space.

Figure 6:
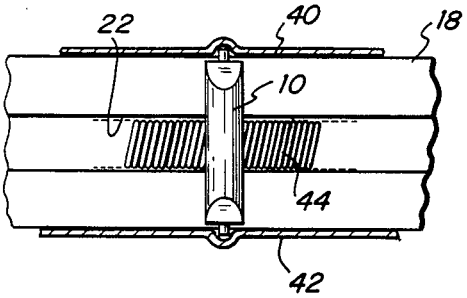
FIG. 6 is a fragmentary elevational view of a portion of a wrench, showing an exemplary cam held in a non-driving position by a coil spring and two face plates.

Referring next to FIG. 6, which is a fragmentary view of the interior portion of a wrench, the cam 10 is urged toward the interior of the wrench head by coil spring 44 which extends circumferentially around the inside of head 18. The coil spring 44 is anchored at its ends to the head 18 at both sides of the opening 20 (FIG. 3) using an anchor pin or the like. The spring 44 is displaced into groove 22 when any of the cams are rotated by virtue of contact with a workpiece.

In operation, the wrench described herein is intended to employ an attached lever arm of some kind to rotate the wrench head 18 in the appropriate direction to impart torque to an engaged workpiece W. But, while it may be true that ratchet wrenches of the prior art have operated in a manner somewhat similar to what has been described thus far, the very slight difference between the diameters of the inner and the outer circles (on which the cusps are centered) has made it necessary that a given wrench in accordance with the prior art be rather tightly designed. In practice, what this means is that a wrench made pursuant to teachings of the Kavalar patent and being nominally sized to receive certain nuts would not be useable to rotate nuts having a nominal size only 1/32 larger—because the larger nuts could not normally be inserted into the space between diametrically opposed cams in the tightly dimensioned head. In other words, a ratchet wrench made with cams according to the prior art cannot normally be made to turn an over-size nut because the larger nut cannot under normal working conditions be inserted into the wrench. As an example, if someone wanted to use a commercially available 9/16 inch ratchet wrench on a 15 mm nut, it could not be done under working conditions even though there is a difference of less than one millimeter between a 9/16 nut and a 15 mm nut (i.e., 14.2875 mm versus 15.0000 mm). But with this invention, it is possible to have a wrench which can accept both the nominal 9/16 inch nut and the slightly larger 15 mm nut, and other wrenches can be used on similarly paired nuts, such as ⅜ inch and 10 mm, ½ inch and 13 mm, 13/16 inch and 21 mm, etc.

The key to the versatility of this improved wrench is the beveled surface 12 at the entry end of the cams 10. When an over-size nut is placed next to the head of a wrench, the "corners" of the nut engage the beveled, planar surface 12. With the application of a slight pressure and backward twist of the wrench, the nut corner catches the beveled surface 12 and rotates it out of the way back into cusp 30, thereby permitting the corners of the nut to slip into the areas between the cams 10. Providing a series of linear grooves or surface irregularities (or even grinding marks) in a longitudinal direction improves the ability of a cam's beveled surface 12 to engage and be turned by a confronting nut. (The advantage of a surface texture even as slight as that provided by longitudinal grinding marks is particularly significant when the nut to be turned is a hollow nut of the kind sold under the trademark PALNUT). Expressing the nut/cam interaction in another way, a very smooth and slippery surface on the beveled face 12 would *not* usually be advantageous, because it would probably make it harder for one of the two elements to "bite" into the other so that the two could be turned together. Thus, a textured surface 12 has improved frictional characteristics and is preferred over a perfectly smooth surface. Further, a beveled, planar surface clearly has significant advantages over a conical-shaped cam since the latter has no inherent gripping surface necessary to the operation of the invention.

A few of the cams may not be affected by the slight backward twisting of a nut, if those cams happen to be positioned where they are next to a flat instead of a corner of the nut. But with just slight wrist action and modest pressure, those particular cams will be rotated out of the way which would otherwise block the entrance of an over-size nut into the C-shaped opening. The nut will soon be aligned in such a way that it can be easily slipped into the wrench head. Forward rotation of the head 18 will then cause certain ones of the cams 10 (which happen to be at just the right relative position with respect to the nut) to become wedged between the nut and the "power grooves" of the head, i.e., cusps 28; the desired application of torque to the nut is then accomplished by continued forward rotation of the wrench head. FIG. 7 provides a tabular showing of several wrenches that are capable of accomodating either a nut that is sized in accordance with the British measuring system or a closely sized nut that is denominated as to size in millimeters. Those skilled in the art will recognize that some of these "pairings" are almost a millimeter apart, so it should be apparent that a much more versatile wrench is possible with the cam configuration disclosed herein.

While only the preferred embodiments of the invention have been disclosed herein in substantial detail, it should be readily apparent that modifications in the basic design could be realized without departing from the general concepts that have been disclosed. Therefore, the specific embodiments shown herein are not intended to be limiting, and the breadth of the invention should be understood to be measured only by the scope of the attached claims.

What is claimed is:

1. In a cam-lock wrench having an opening therein to engage a nut, and a plurality of spring-loaded, cylindrical cams eccentrically and pivotably attached about on inner periphery of the opening, said cams being arranged to grip the nut when the wrench is turned in the forward direction and to ratchet when turned in the reverse direction, the improvement comprising:

one end of each of said cams being provided with a planar bevel having a gripping surface thereon for engagement by the vertices of a nut to create an eccentric rotative action of the cams whereby oversized nuts may be inserted into said opening and the vertices thereof will engage the gripping surface of the planar bevel when said wrench is turned in the reverse direction and cause an eccentric rotative retraction of the cams, thereby permitting said nut to slip into said opening between said cams.

2. In a cam-lock wrench in accordance with claim 1 wherein both ends of said cams are provided with a planar bevel, whereby said wrench may be reversed and may thereby be used to rotate said nut in either a clockwise or counterclockwise direction.

3. In a cam-lock wrench in accordance with claim 2 wherein the gripping surfaces are longitudinally-textured surfaces to enhance frictional engagement of said nut with said planar bevel.

4. In a cam-lock wrench in accordance with claim 3 wherein each of said planar bevels constitutes less than 25% of the length of said cams.

5. In a cam-lock wrench in accordance with claim 4 wherein each of said cams is beveled such that the bevelled portion constitutes less than 25% of said cam's length.

6. A ratchet wrench, comprising:

a generally cylindrical and flat head having an opening in its center for engaging a workpiece, and the interior surface of the head having a center that coincides with the central axis of the head, and there being inner and outer circles which are also concentric with the head, and there being a plurality of cusp-shaped indentations on the interior face of the head, with half of said indentations having their centers on said inner circle and the remainder of the indentations having their centers on the outer circle, and the two sets of cusp-shaped indentations being spatially arranged around the interior face of the head in an alternating fashion;

a pair of face plates affixed respectively to opposite sides of the head so as to form front and rear face plates, and the face plates being affixed to the head with mechanical fasteners that are spaced sufficiently close such that adjacent fasteners are no more than ¾ inch apart, and the face plates collectively having a plurality of aligned and juxtaposed dimples whose centers lie on a circle whose diameter is larger than the inner circle and smaller than the outer circle;

a plurality of work-contacting cams eccentrically and pivotally mounted on the head and arranged to be generally co-extensive and parallel, and each cam having a pair of longitudinally aligned protuberances which extend outwardly at opposite ends of each cam, and the size of each protuberance being slightly smaller than the size of the dimples in said face plates, such that the protuberances will have a loose fit within their associated dimples when the cams are mounted between the juxtaposed face plates, and the cams collectively having a first set of ends adjacent the front face plate and a second set of ends adjacent the rear face plate, and at least one of the two sets of cam ends being beveled in a direction toward the center of the head; and wherein said planar bevel has a gripping surface thereon for vertices of a nut to engage to create an eccentric rotative action of the cams whereby oversized nuts may be inserted into said opening and the vertices thereof will engage the gripping surface on the planar bevel when said wrench is turned in the reverse direction and cause an eccentric rotative retraction of the cams, thereby permitting said nut to slip into said opening between said cams;

a resilient member constantly urging the cams inwardly where they rest adjacent those cusp-shaped indentations which lie on the inner circle, and said resilient member being yieldable to permit at least some of the cams to temporarily eccentrically rotate outwardly into those cusp-shaped indentations which lie on the outer circle, whereby certain of the cams may be wedged between the interior surface of the head and the workpiece, and whereby torque may be applied to the workpiece through the wedged cams.

7. The ratchet wrench as claimed in claim 6 wherein the central opening in the wrench head is sufficiently large as to accomodate various workpieces that differ in size by as much as 1 millimeter, whereby a given wrench may accomodate a range of differently sized workpieces.

8. The ratchet wrench as claimed in claim 6 wherein both sets of cam ends are beveled, whereby workpieces may be easily inserted into a wrench for subsequent rotation in a desired direction that is either clockwise or courterclockwise.

9. The ratchet wrench as claimed in claim 6 wherein the gripping surface are longitudinally textured surfaces to enhance frictional engagement of the nut with the cam ends, and such that the rotation of a given cam about its longitudinal axis is fostered by the application of a transverse force applied through the workpiece and against said textured surface.

10. The ratchet wrench as claimed in claim 6 wherein the cams have a certain length between their protuberances, and the beveled portion at any end of a cam constitutes less than 25% of said certain length, such that at least 50% of the bearing area along the sides of said cams remains unaltered by said beveling.

11. The ratchet wrench as claimed in claim 6 wherein the ends of the cams are beveled at an angle of at least 45 degrees with respect to a transverse plane through the plurality of cams.

* * * * *